United States Patent [19]

Lingle

[11] 4,070,848

[45] Jan. 31, 1978

[54] FASTENING BAR ASSEMBLY FOR FRAMELESS INSULATING PANELS

[76] Inventor: Cleo M. Lingle, 1201 Montclair, Longview, Tex. 75601

[21] Appl. No.: 791,875

[22] Filed: Apr. 28, 1977

[51] Int. Cl.[2] ..... E04B 1/41

[52] U.S. Cl. ..... 52/707; 52/583; 52/584; 52/619; 52/713; 52/721

[58] Field of Search ..... 85/80; 151/41.7; 52/720, 582, 584, 583, 127, 309.9, 707, 713, 721

[56] References Cited

U.S. PATENT DOCUMENTS

| | | | |
|---|---|---|---|
| 2,540,468 | 2/1951 | Anderson | 52/584 X |
| 2,728,127 | 12/1955 | Armstrong | 52/127 X |
| 2,741,341 | 4/1956 | Anderson | 52/127 X |
| 2,784,865 | 3/1957 | Rieke | 85/80 |
| 2,936,015 | 5/1960 | Rapata | 85/80 |
| 2,946,612 | 7/1960 | Ahlgren | 85/80 |
| 2,975,814 | 3/1961 | Tinnerman | 85/80 |
| 3,365,851 | 1/1968 | Cushman | 52/127 X |
| 3,496,692 | 2/1970 | Melcher | 52/583 |
| 3,701,373 | 10/1972 | Wronke et al. | 85/80 X |

*Primary Examiner*—Leslie Braun
*Attorney, Agent, or Firm*—D. Paul Weaver

[57] ABSTRACT

A bar assembly for securely interconnecting frameless insulating panels for walk-in refrigerators, refrigerated warehouses and the like, includes a bar body having apertured anchor elements spot welded thereto. Non-metallic, preferably nylon, female threaded coupling pods are snapped into the apertures of the anchor elements and have rectangular flange plates which resist rotation of the pods in the assembly. The threaded pods receive lag screws of fastening bar assemblies in adjacent insulating panels. A super strong threaded connection is assured and thermal conductivity in the system is greatly reduced. A greatly expedited assembly of the fastening bars is also attained.

3 Claims, 9 Drawing Figures

FASTENING BAR ASSEMBLY FOR FRAMELESS INSULATING PANELS

CROSS-REFERENCE TO RELATED APPLICATION

This application contains common subject matter with prior copending application Ser. No. 730,849, filed Oct. 8, 1976, now U.S. Pat. No. 4,044,511 for FASTENING MEANS FOR FRAMELESS INSULATING PANELS.

BACKGROUND OF THE INVENTION

This invention is an improvement on the construction disclosed in the above-referenced patent application, and more particularly, this invention is concerned with an improved and simplified fastening bar assembly for foamed-in-place frameless metal skin covered insulating panels of the character disclosed in said prior application. The improved fastening bar assembly simplifies and considerably expedites the fabrication of the bar assemblies and assures a more secure threaded connection between adjacent insulating panels. The use of non-metallic, preferably nylon, female threaded couplings or pods eliminates corrosion and rust at the most vital points between adjacent panels and interrupts heat transfer at the interfaces between panels, thus significantly improving the insulating capability of an entire structure embodying the invention. The improved screw-threaded connection between adjacent panels assures adjustable tension for panel gaskets.

A significant feature of the present invention resides in the use of tough durable non-metallic female threaded pods which are snapped into assembled relationship with apertured anchors or brackets on the fastening bar body. This expedites assembly by eliminating screws or the like for attaching the threaded pods to their anchors. Integral rectangular flange plates on the bases of the threaded pods prevent rotation of the pods on their anchors.

The nylon pods have their lag screw receiving threaded bores recessed and beveled to further expedite connecting adjacent panels.

The invention retains the main advantageous features disclosed in the above-referenced application including the protective box and retainer means for a lag screw at one end of each fastening bar assembly.

Other features and advantages of the invention will become apparent to those skilled in the art during the course of the following detailed description.

DETAILED DESCRIPTION

Figure 1:
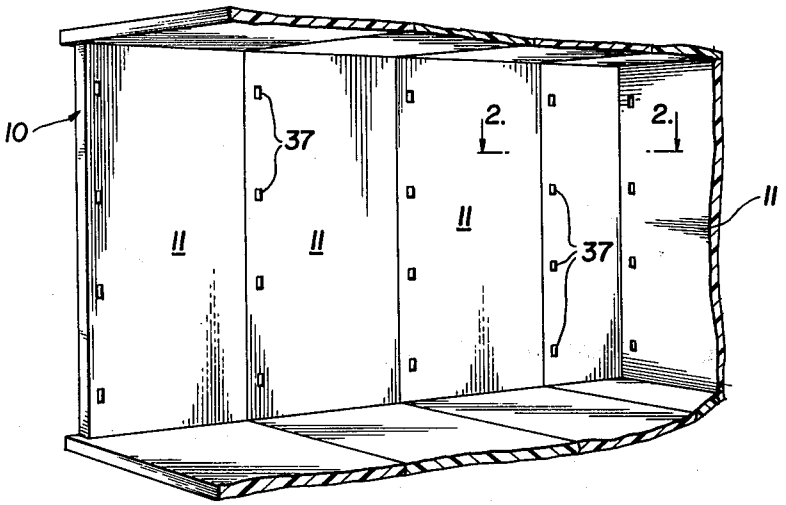
FIG. 1 is a fragmentary perspective view of an insulated enclosure, such as a walk-in freezer, constructed with frameless insulating panels and panel fastening bar assemblies in accordance with the invention.

Referring to the drawings in detail, wherein like numerals designate like parts, an insulated enclosure 10, such as a refrigerated warehouse, walk-in freezer, or the like is constructed from edge-to-edge connected foam-filled metal skin covered rectangular insulating panels 11 of varying width to meet the needs of a particular application. The insulating panels 11 are foamed in place and are frameless in accordance with the teachings of the above-referenced application. Temporary end jig fixtures, not shown herein, are employed to support the fastening bar assemblies and the metal skins while insulating foam is being introduced. Following the curing of the panels, the jig fixtures are removed and the fastening bar assemblies are encapsulated bodily in the foam cores of the panels and the metal skins are permanently attached as disclosed in said application.

The improved panel fastening bar assemblies according to this invention have several different specific forms, as illustrated in FIGS. 2, 7, 8 and 9 but all forms of the invention have certain common and characteristic features.

Figure 3:
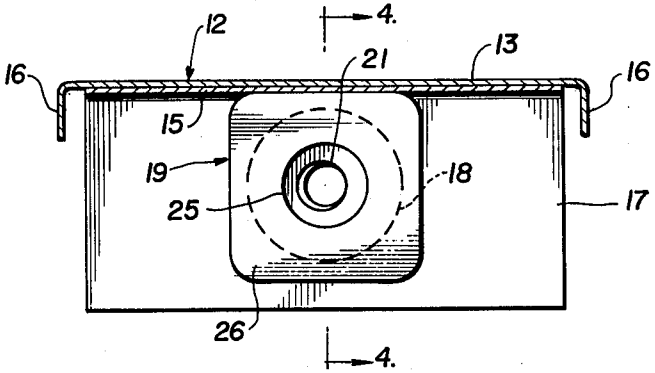
FIG. 3 is an enlarged fragmentary transverse vertical section through the fastening bar assembly taken on line 3—3 of FIG. 2.
Figure 2:
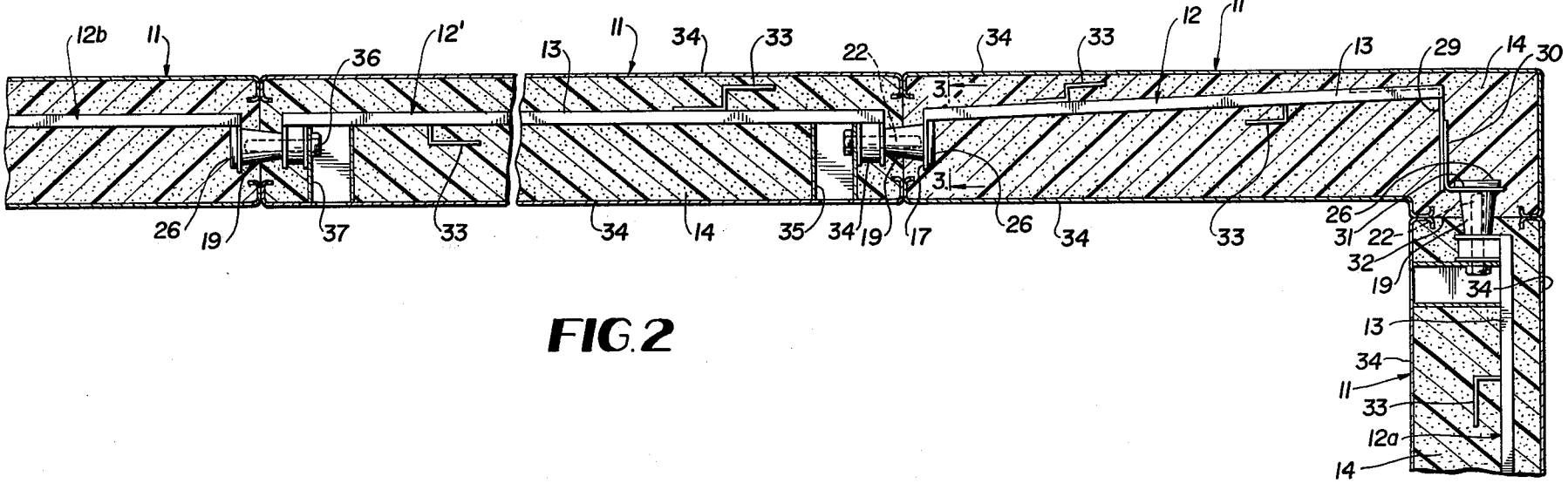
FIG. 2 is an enlarged fragmentary horizontal section taken on line 2—2 of FIG. 1.
Figure 4:
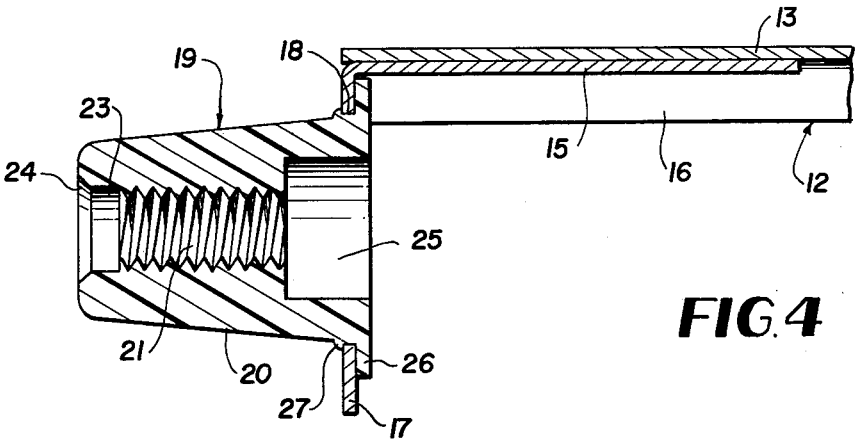
FIG. 4 is a fragmentary vertical section taken on line 4—4 of FIG. 3.
Figure 5:
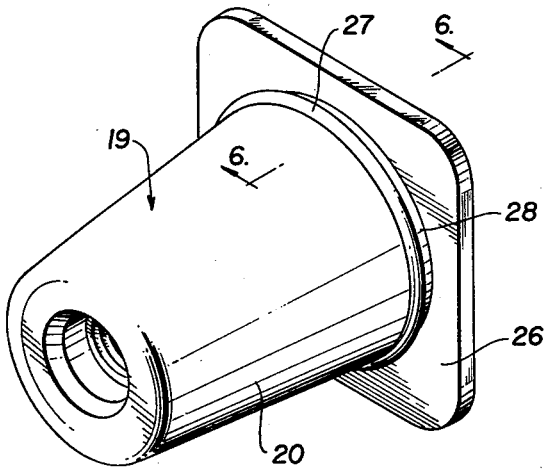
FIG. 5 is a perspective view of a non-metallic threaded coupling or pod utilized in the invention.
Figure 6:
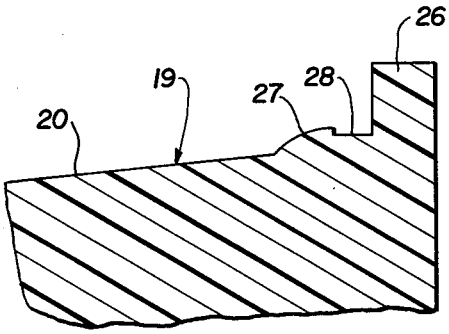
FIG. 6 is an enlarged fragmentary vertical section taken on line 6—6 of FIG. 5.

Referring to FIG. 2, a panel fastening bar assembly 12 embodying the invention comprises a channel cross section bar body 13 of galvanized metal and being of a length to extend for the major part of the width of one insulating panel 11 which is a corner panel in FIG. 2. The bar 13 is fully encapsulated in the rigid insulating foam core 14 of the panel 11. As shown in FIGS. 3 and 4, a 90° anchor bracket has one web 15 thereof spot welded to the main web of the bar body 13 between the side flanges 16 of the latter. The other web 17 of the right angular anchor bracket projects away from the bar body 13 at right angles and is provided with a circular aperture 18. A non-metallic female threaded coupling or pod 19 forming a key element of the invention preferably molded from nylon or some similar material is connected with and supported on the web 17. More particularly, the pod 19 has a conically tapered body 20 provided with a central axial threaded bore 21, adapted to receive a lag screw 22 carried by the next adjacent fastening bar assembly 12' in the next adjacent insulating panel, FIG. 2, according to the lag screw arrangement in the above-referenced application. To facilitate guidance of the lag screw into the threaded bore 21, the pod 19 is counterbored or recessed as at 23 near its leading end and a beveled face 24 leads from the recess 23 through the front end face of the pod. The interior end of the pod may also be recessed as at 25 to reduce the amount of material involved.

The unitary pod or coupling 19 has a rear end flat rectangular flange plate 26 formed thereon for abutment with the opposing face of the web 17. Spaced slightly ahead of the flange plate 26 is an annular bead 27 on the exterior of the body 20 of sufficient resiliency to snap into engagement with the web 17 lockingly after passing through the aperture 18. The pod 19 can be snapped into place permanently on the anchor web 17 by tapping with a hammer or mallet. If need be, the pod can be removed from the web 17 in a similar manner.

As best shown in FIG. 3, one edge of the rectangular flange plate 26 lies very close to the web 15 and thus prevents rotation of the pod 19 relative to its supporting web 17 once the parts are snapped into assembled relationship. Following such assembly, the web 17 is snugly engaged between the flange plate 26 and the locking bead 27 of the pod. A cylindrical surface 28 on the pod 19 between the bead 27 and flange plate 26 fits closely within the circular aperture 18 of web 17. In this manner, each pod 19 is very firmly mounted on its right angular anchor bracket and can withstand any and all forces to which it is subjected in an enclosure consisting of assembled insulating panels 11.

The use of the molded nylon or equivalent material pod 19 has several advantages in the ultimate insulated building structure. The non-metallic threads 21 tend to be self-locking and they grip the threads of the lag screw 22 which is metallic. The arrangement provides a super strong threaded connection between adjacent panels without corrosion or rusting so that the structure can be easily disassembled in the future, if need be. The threaded connection also assures adjustable tension for panel gaskets. Very importantly, the non-metallic pods 19 at the joints or interfaces between insulating panels break the transfer of heat at the most critical points in the insulated enclosure. This is a distinct advantage over all metallic fastening means in maintaining the thermal integrity of the entire insulated enclose or structure, as will be appreciated by those skilled in the art. Additionally, the snap-together assembly mode for the pods 19 on their anchors in the fastening bar assemblies eliminates the need for screws or other separable fasteners and saves much time and cost in the assembling of the fastener bars.

Continuing to refer to FIG. 2, the bar assembly 12 at its end remote from the web 17 includes a right angular extension 29 to which a second 90° degree anchor bracket 30 is spot welded with one web 31 thereof projecting beyond the extention 29 and parallel to the end face 32 of the corner panel 11. The web 31 is apertured in the exact manner that the web 17 is apertured at 18, FIG. 4, and an identical nylon pod or connector 19 is snapped into assembled relationship with the web 31 as illustrated in FIG. 2. The arrangement facilitates connecting the corner panel 11 with two adjacent panels 11 of a ninety degree corner wall structure. More particularly, the described fastening bar assembly 12 through its first-described pod 19 is connected with the lag screw 22 of bar assembly 12', and through the second-described pod 19 on the web 31 is connected with another lag screw 22 of the panel fastening bar assembly **12*a* of the insulated enclosure. As disclosed in the prior application, the bar body 13 of each fastening bar assembly has Z-shaped anchors or stabilizers 33 spot welded thereto on opposite sides of the bar assemblies. These elements 33 are embedded in the rigid foam cores 14 to stabilize the fastening bar assemblies therein. The opposite side metal skins of the insulating panels 11 are indicated in the drawings, FIG. 2**.

Continuing to refer to FIG. 2, the fastening bar assembly 12' differs from the bar assembly 12 and thus constitutes a variation of the invention. The assembly 12' includes the captive lag screw 22 at one end thereof and the associated retainer or guard 34 and access box 35, exactly as disclosed in the referenced prior application. The far end of the assembly 12' in FIG. 2 carries another captive and shielded lag screw 36 with embedded access box 37 likewise in accordance with the teaching of the prior application, the lag screw 36 adapted to engage in a threaded nylon pod 19 of a next adjacent fastening bar assembly **12*b* of another insulating panel 11**.

Figure 7:
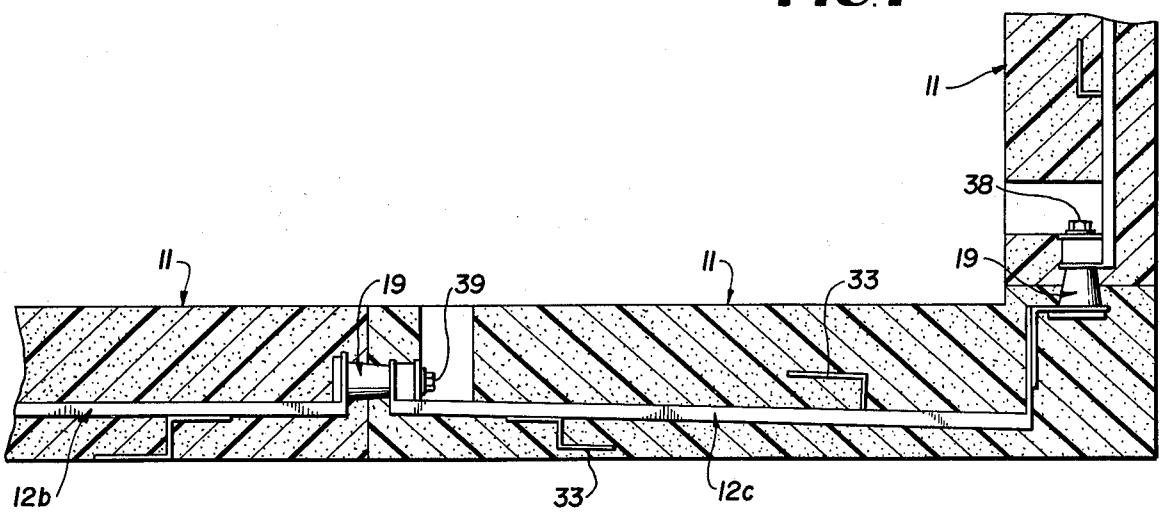
FIG. 7 is a fragmentary horizontal section similar to FIG. 2 showing a variation in the forms of the improved fastening bar assemblies.

Referring to FIG. 7, a further variation of the invention is shown in which a fastening bar assembly **12*c*, similar to the first-described bar assembly 12, is encapsulated in a corner panel 11 and has one nylon pod 19 secured to one end thereof exactly as described and illustrated in the assembly 12 of FIG. 2. This pod 19 receives a lag screw 38 of another panel 11 in a right angular wall corner connection. The opposite end of the bar assembly 12*c*, however, differs from the corresponding end of the assembly 12 by not having a second pod 19. Instead of a second pod as in the assembly 12, a lag screw 39 is carried by the other end of the bar assembly 12*c*, FIG. 7, for engagement within a nylon pod 19 on the adjacent end of a bar assembly of the type identified 12*b* in FIG. 2**.

Figure 8:
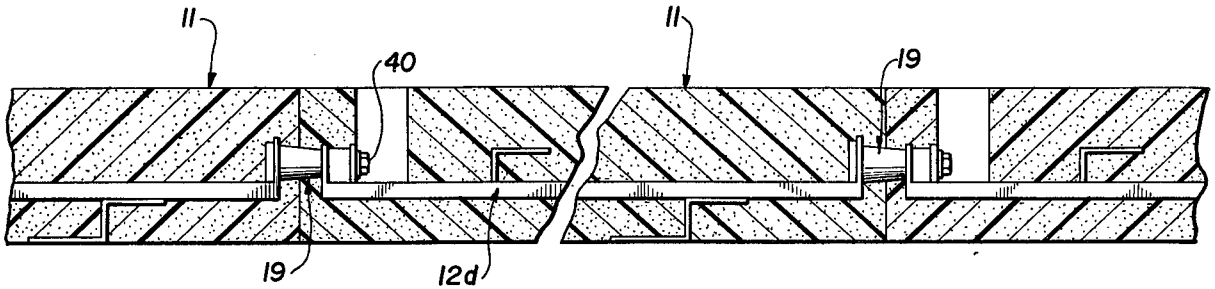
FIG. 8 is a similar sectional view showing a further variation of the invention.

FIG. 8 shows a further variation of the invention in which a fastening bar assembly **12*d* within a panel 11 of the straight-through or non-corner type is equipped at one end with a nylon pod 19 and at its opposite end with a lag screw 40 to be received in a pod 19 of a next adjacent panel 11. Thus, FIGS. 2, 7 and 8** show several variations of the fastening bar assembly as it is used in an insulated enclosure. However, all forms of the bar assembly involve at least one of the non-metallic internally threaded pods which constitutes the key element of the present invention. The various arrangements illustrated reflect the versatility of the invention.

Figure 9:
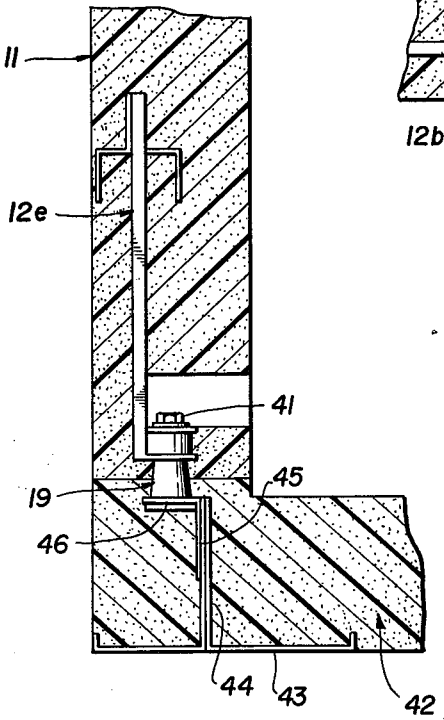
FIG. 9 is a further horizontal cross sectional view showing a variation in corner construction under the invention.

FIG. 9 shows one further variation of the invention wherein an encapsulated fastening bar assembly **12*e* within an insulated wall panel 11 carries a lag screw 41 at one end thereof for reception in a threaded nylon pod 19 of a corner panel 42 having a flush mounted metal bracket 43 secured thereto including an embedded web 44. This web 44 has an angle bracket or anchor 45 spot welded thereto, which anchor has an apertured web 46 receiving the pod 19 in snapped assembled relationship exactly as shown and described previously in connection with FIGS. 2 and 4**.

Therefore, essentially, the invention consists of a bar body 13 having on at least one end thereof a spot welded anchor for a nylon threaded pod 19 according to any one of the configurations of bar assemblies in FIGS. 2, 7 and 8. The same bar assembly may have an opposite end nylon pod in straight-through orientation or a right angular pod for bridging a wall corner as with the assembly 12 in FIG. 2. Alternatively, the assembly may have a straight-through or right angular pod on one end and a lag screw on the opposite end as with the assemblies **12*c* and 12*d* in FIGS. 7 and 8**. The advantages of the invention in all configurations are the same in terms of strength, simplifying assembly of parts, thermal integrity and resistance to rust and corrosion at panel interfaces, and better thread locking capability than in the case of all-metal threaded connectors.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a fastening bar assembly for connecting adjacent insulated panels of an insulated enclosure, a bar body adapted for encapsulation in a foam core of an insulating panel, an apertured anchor plate on one end of the bar body, and a pod formed of low heat conducting material on said apertured anchor plate, said pod being of unit construction and having a through passage from end-to-end thereof, said through passage being internally screw-threaded in a region inwardly of and between the opposite ends of said pod, at least one end of the pod having a recess leading into said screw-threads for the guidance of a screw fastener element into the screw-threads, said pod having a flange plate on its opposite end extending beyond the peripheral surface of the pod and having at least one straight edge engaging a flat face of the fastening bar assembly and resisting rotation of the pod on said apertured anchor plate, and the pod having a forwardly tapering locking bead spaced somewhat forwardly of the flange plate in parallelism therewith and adapted for snapping through the aperture of the anchor plate to hold the pod captive on the anchor plate with the bead on one side thereof and the flange plate on the other side thereof.

2. In a fastening bar assembly for connecting adjacent insulating panels of an insulated enclosure as defined in claim 1, and said pod formed of nylon and being molded.

3. In a fastening bar assembly for connecting adjacent insulating panels of an insulated enclosure as defined in claim 1, and said pod having a conically tapered body portion including a solid side wall, said flange plate being rectangular and projecting radially beyond the body portion and said bead at all points around the circumference of the body portion and bead, and said bead behind annular and forming with the flange plate a continuous annular groove for the reception of the apertured anchor plate clampingly between the bead and flange plate.

* * * * *